US008519934B2

(12) United States Patent
Huang et al.

(10) Patent No.: US 8,519,934 B2
(45) Date of Patent: Aug. 27, 2013

(54) LINEAR CONTROL OUTPUT FOR GATE DRIVER

(75) Inventors: Wen-Chiang Huang, Hsnchu (TW); Sheng-Kai Hsu, Hsinchu (TW)

(73) Assignee: Au Optronics Corporation, Hsinchu (TW)

( * ) Notice: Subject to any disclaimer, the term of this patent is extended or adjusted under 35 U.S.C. 154(b) by 574 days.

(21) Appl. No.: 12/757,607

(22) Filed: Apr. 9, 2010

(65) Prior Publication Data

US 2011/0248971 A1 Oct. 13, 2011

(51) Int. Cl.
*G09G 3/38* (2006.01)

(52) U.S. Cl.
USPC ..... 345/100; 345/94; 345/92; 345/205; 345/204

(58) Field of Classification Search
USPC . 345/87, 92, 100, 204, 205, 208; 377/64–81; 365/78
See application file for complete search history.

(56) References Cited

U.S. PATENT DOCUMENTS

| | | | | |
|---|---|---|---|---|
| 5,587,722 | A * | 12/1996 | Suzuki et al. | 345/94 |
| 6,359,607 | B1 * | 3/2002 | Yanagi et al. | 345/94 |
| 6,421,038 | B1 * | 7/2002 | Lee | 345/98 |
| 6,924,683 | B1 * | 8/2005 | Hayter | 327/218 |
| 6,943,786 | B1 | 9/2005 | Birk et al. | |
| 7,002,542 | B2 * | 2/2006 | Lee | 345/94 |
| 7,265,299 | B2 * | 9/2007 | Hu et al. | 174/257 |
| 7,304,622 | B2 * | 12/2007 | Kobayashi et al. | 345/87 |
| 7,327,338 | B2 * | 2/2008 | Moon | 345/87 |
| 7,362,292 | B2 * | 4/2008 | Deane et al. | 345/87 |
| 7,586,477 | B2 * | 9/2009 | Lee | 345/98 |
| 7,696,969 | B2 * | 4/2010 | Yanagi et al. | 345/94 |
| 2002/0033676 | A1 | 3/2002 | Harada et al. | |
| 2005/0194179 | A1 | 9/2005 | Hu et al. | |
| 2006/0092109 | A1 | 5/2006 | Hsu et al. | |
| 2008/0084408 | A1 * | 4/2008 | Nishimura | 345/205 |
| 2012/0154361 | A1 * | 6/2012 | Wu et al. | 345/211 |
| 2012/0194497 | A1 * | 8/2012 | Wu | 345/211 |
| 2013/0002627 | A1 * | 1/2013 | Wu | 345/208 |

FOREIGN PATENT DOCUMENTS

| | | | |
|---|---|---|---|
| DE | 19944724 | A1 | 8/2000 |
| EP | 2375401 | A1 * | 10/2011 |
| GB | 2341714 | A | 3/2000 |

* cited by examiner

*Primary Examiner* — Lun-Yi Lao
*Assistant Examiner* — Peter D McLoone
(74) *Attorney, Agent, or Firm* — Morris, Manning & Martin LLP; Tim Tingkang Xia, Esq.

(57) ABSTRACT

The present invention relates to a gate driver circuit and application of the same in a liquid crystal display (LCD) for improving the display performance thereof. The gate driver circuit includes at least one PMOS transistor and two NMOS transistors configured to modify a falling edge of a corresponding scanning signal according to a linear function that defines a waveform shape for the scanning signal.

26 Claims, 8 Drawing Sheets

LINEAR CONTROL OUTPUT FOR GATE DRIVER

FIELD OF THE INVENTION

The present invention relates generally to a liquid crystal display (LCD), and more particularly to a modified gate driver circuit to improve display performance of the liquid crystal display.

BACKGROUND OF THE INVENTION

An LCD device includes an LCD panel formed with liquid crystal cells and pixel elements with each associating with a corresponding liquid crystal cell and having a liquid crystal (LC) capacitor and a storage capacitor, a thin film transistor (TFT) electrically coupled with the liquid crystal capacitor and the storage capacitor. These pixel elements are substantially arranged in the form of a matrix having a number of pixel rows and a number of pixel columns. Typically, scanning signals are sequentially applied to the number of pixel rows for sequentially turning on the pixel elements row-by-row. When a scanning signal is applied to a pixel row to turn on corresponding TFTs of the pixel elements of a pixel row, source signals (i.e., image signals) for the pixel row are simultaneously applied to the number of pixel columns so as to charge the corresponding liquid crystal capacitor and storage capacitor of the pixel row for aligning orientations of the corresponding liquid crystal cells associated with the pixel row to control light transmittance therethrough. By repeating the procedure for all pixel rows, all pixel elements are supplied with corresponding source signals of the image signal, thereby displaying the image signal thereon.

Referring to FIG. 1, an illustrative structure and operating principle of a typical LCD panel is provided. Specifically, the conventional gate driver circuits and source driver circuits formed on the TFT display have the following problems: as the screen size of the LCD panel becomes larger, scanning signals from gate driver circuits, which act as switches for turning on and off the TFTs through respective gate lines, become distorted due to the loading effect.

FIG. 2 is a view representing a TFT-LCD employing a conventional gate driver circuit configuration. Specifically, a set of scanning or data signals is provided by the gate IC internal circuit, and subsequently driven by the gate IC output buffer circuit. Each resulting data signal in the shape of a square waveform is then processed by a gate line (display panel) loading circuit.

In order to reduce the load difference between the scanning signals at opposite ends, adjustment needs to be made to the output waveform of the scanning signal through, e.g., linear control, to achieve consistency on the scanning signals at the opposite ends, and allow for a uniform display of the LCD panel.

Such modification of the scanning signals' waveform through linear adjustments, detection, and output control, notwithstanding the loading effect, would yield more consistent scanning signals, avoid unnecessary power loss and burning of the circuit function, minimize control circuit components to save costs, and reduce current to achieve energy saving.

SUMMARY OF THE INVENTION

In one aspect, the present invention relates to a gate driver circuit usable in the LCD. In one embodiment, the gate driver circuit includes a gate IC internal circuit for generating a scanning signal, a gate IC output buffer circuit for modifying the scanning signal according to a linear function, with the gate IC output buffer having a set of circuit components comprising a PMOS transistor, a first NMOS transistor, and a second NMOS transistor; and a gate line loading circuit for receiving a modified scanning signal from the gate IC output buffer circuit.

Specifically, the gate IC output buffer circuit modifies a falling edge of the scanning signal according to a linear or slope function that defines a waveform shape, such as trapezoid, for the modified scanning signal.

An exemplary composition of the IC output buffer circuit includes (1) a source line of the PMOS transistor coupled to a VGG voltage, a gate line of the PMOS transistor connected to the gate IC internal circuit, and a drain line of the PMOS transistor connected to the gate line loading circuit, (2) a source line of the first NMOS transistor coupled to a VEE voltage, a gate line of the first NMOS transistor connected to the gate IC internal circuit, and a drain line of the first NMOS transistor connected to the drain line of the PMOS transistor, and (3) a source line of the second NMOS transistor connected to a >VEE voltage, a gate line of the second NMOS transistor connected to the gate IC internal circuit, and a drain line of the second NMOS transistor connected to the drain line of the PMOS transistor.

In addition, the gate line loading circuit has at least one resistor connected to a capacitor, wherein one end of the resistor is connected to the gate IC output buffer, and one end of the capacitor is connected to a VCOM voltage. The linear function of the falling edge of the scanning signal is determined by both output drop period and output drop voltage, which in turn is determined by a turn-on period of the second NMOS transistor.

In a first configuration according to another aspect of the present invention, the LCD has a gate IC internal circuit for generating a scanning signal, a gate IC output buffer circuit for modifying the scanning signal according to a linear function, with the gate IC output buffer circuit having at least two sets of circuit components each comprising a PMOS transistor, a first NMOS transistor, and a second NMOS transistor, a gate line loading circuit for receiving the modified scanning signal from the gate IC output buffer circuit; and a resistor $R_E$ having one end connected to a source line of one of said first and second NMOS transistors of each set of circuit components, and the other end connected to ground.

Within each set of circuitry, the PMOS transistor has a source line coupled to a VGG voltage, a gate line connected to the gate IC internal circuit, and a drain line connected to a Vout voltage to the gate line loading circuit; the first NMOS transistor has a source line coupled to a VEE voltage, a gate line connected to the gate IC internal circuit, and a drain line connected to the drain line of the PMOS transistor; and the second NMOS transistor has a source line connected to a Vbias voltage, a gate line connected to the gate IC internal circuit, and a drain line connected to the Vout voltage and drain line of the PMOS transistor.

In a second configuration, a voltage source is connected to the resistor on one end, and to the ground at the other end. Since the voltage source and resistor are coupled to the gate IC output buffer on one end so that each one of the second NMOS transistors is subjected to a fixed current due to the resistance, the output voltage Vout would proportionally decrease due to the bias voltage Vbias, thereby allowing the output drop voltage to be controlled. Additionally, the turn on time period of each of the second NMOS transistors would determine the output drop period.

In a third configuration, a voltage source is connected to a gate line of one of the NMOS transistors at one end, and connected to the ground at the other end, of which a source line of one of the NMOS transistors is connected to ground. Since the voltage source is connected to each gate channel of each one of the NMOS transistors, and each source channel of each one of the NMOS transistors is grounded, the output voltage Vout would be subjected to VGG when each of the NMOS transistor is turned on, thereby allowing the output drop voltage to be controlled. Additionally, the turn on time period of each NMOS transistor would determine the output drop period.

According to yet another aspect of the present invention, a method for modifying a scanning signal in a liquid crystal display (LCD) has the steps of generating the scanning signal through a gate IC internal circuit, modifying the scanning signal through a gate IC output buffer circuit according to a linear function based on an output drop period and an output drop voltage; and receiving a modified scanning signal through a gate line loading circuit, wherein the modified scanning signal has a falling edge with a linear function that defines a waveform shape for the modified scanning signal.

Specifically, by controlling the output drop voltage and output drop period, the waveform of the scanning signal can take a trapezoidal shape.

In a further aspect, the present invention relates to a gate driver circuit usable in a liquid crystal display (LCD). In one embodiment, the gate driver circuit has a gate IC internal circuit for generating a scanning signal; a gate IC output buffer circuit for modifying said scanning signal, said gate IC output buffer comprises first and second paths for discharge at different times; and a gate line loading circuit for receiving a modified scanning signal from the gate IC output buffer circuit.

In one embodiment, said gate IC output buffer circuit is configured such that when said scanning signal falls, the first discharging path is turned on for discharging of said scanning signal at a first current for a period of time, and the second discharging path is sequentially turned on for discharging of said scanning signal at a second current greater than the first current, so as to modify the falling edge of said scanning signal according to a linear function that defines a waveform shape for said modified scanning signal, where said waveform shape is a trapezoid.

Said gate IC output buffer circuit comprises a PMOS transistor having a source line coupled to a VGG voltage, a gate line connected to said gate IC internal circuit, and a drain line connected to said gate line loading circuit; a first NMOS transistor having a source line coupled to a VEE voltage, a gate line connected to said gate IC internal circuit, and a drain line connected to said drain line of said PMOS transistor, and a second NMOS transistor having a source line connected to a >VEE voltage, a gate line connected to said gate IC internal circuit, and a drain line connected to said drain line of said PMOS transistor.

When the second NMOS transistor is turned on, the first discharging path is turned on, and vice versa, and wherein the first NMOS transistor is turned on, the second discharging path is turned on, and vice versa. In one embodiment, said linear function is determined by a turn-on period of said second NMOS transistor.

In one embodiment, said gate line loading circuit comprises a least one resistor connected to a capacitor, wherein one end of said resistor is connected to said gate IC output buffer, and one end of said capacitor is connected to a VCOM voltage.

In yet a further aspect, the present invention relates to a liquid crystal display (LCD) comprising a gate IC internal circuit for generating a scanning signal; a gate IC output buffer circuit for modifying said scanning signal, said gate IC output buffer comprises first and second paths for discharge at different times; a gate line loading circuit for receiving a modified scanning signal from the gate IC output buffer circuit; and a resistor $R_E$ having one end connected to a source line of one of said first and second NMOS transistors of each set of circuit components, and the other end connected to ground.

In one embodiment, said gate IC output buffer circuit is configured such that when said scanning signal falls, the first discharging path is turned on for discharging of said scanning signal at a first current for a period of time, and the second discharging path is sequentially turned on for discharging of said scanning signal at a second current greater than the first current, so as to modify the falling edge of said scanning signal according to a linear function that defines a waveform shape for said modified scanning signal, wherein said waveform shape is a trapezoid.

Said gate IC output buffer circuit comprises a PMOS transistor having a source line coupled to a VGG voltage, a gate line connected to said gate IC internal circuit, and a drain line connected to said gate line loading circuit; a first NMOS transistor having a source line coupled to a VEE voltage, a gate line connected to said gate IC internal circuit, and a drain line connected to said drain line of said PMOS transistor, and a second NMOS transistor having a source line connected to a >VEE voltage, a gate line connected to said gate IC internal circuit, and a drain line connected to said drain line of said PMOS transistor.

In one embodiment, when said second NMOS transistor is turned on, said first discharging path is turned on, and vice versa, and wherein said first NMOS transistor is turned on, said second discharging path is turned on, and vice versa. Said linear function is determined by a turn-on period of said second NMOS transistor.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment, wherein.

DETAILED DESCRIPTION OF THE INVENTION

Figure 1:
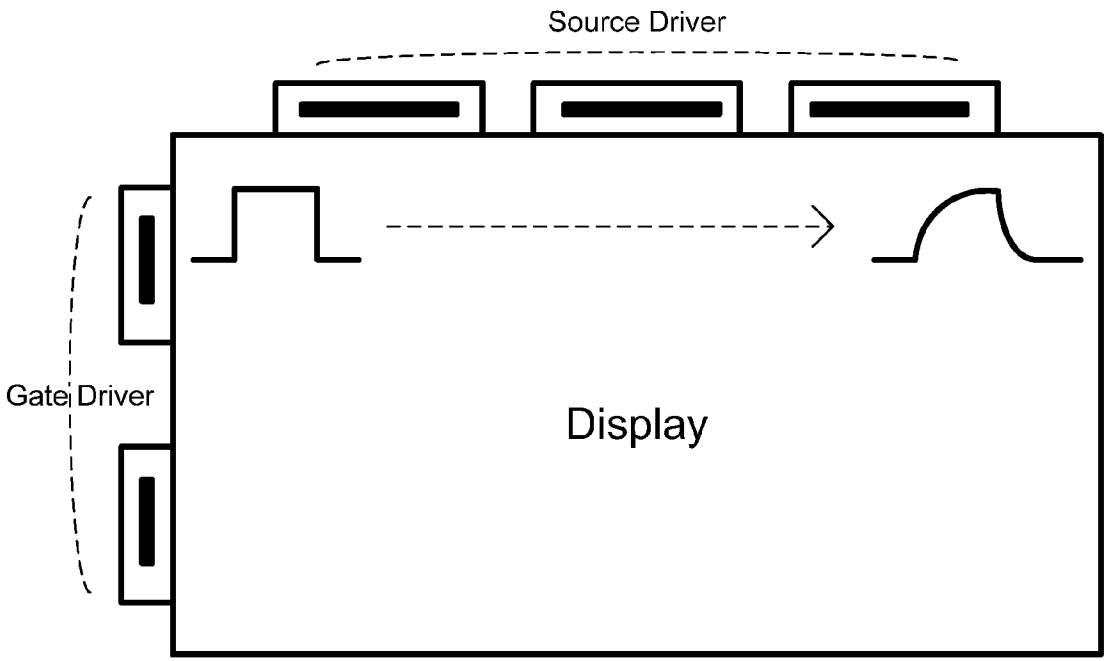
Fig. 1 (Related Art)
FIG. 1 is a typical view for explaining the problem of a conventional gate driver circuit.
Figure 2:
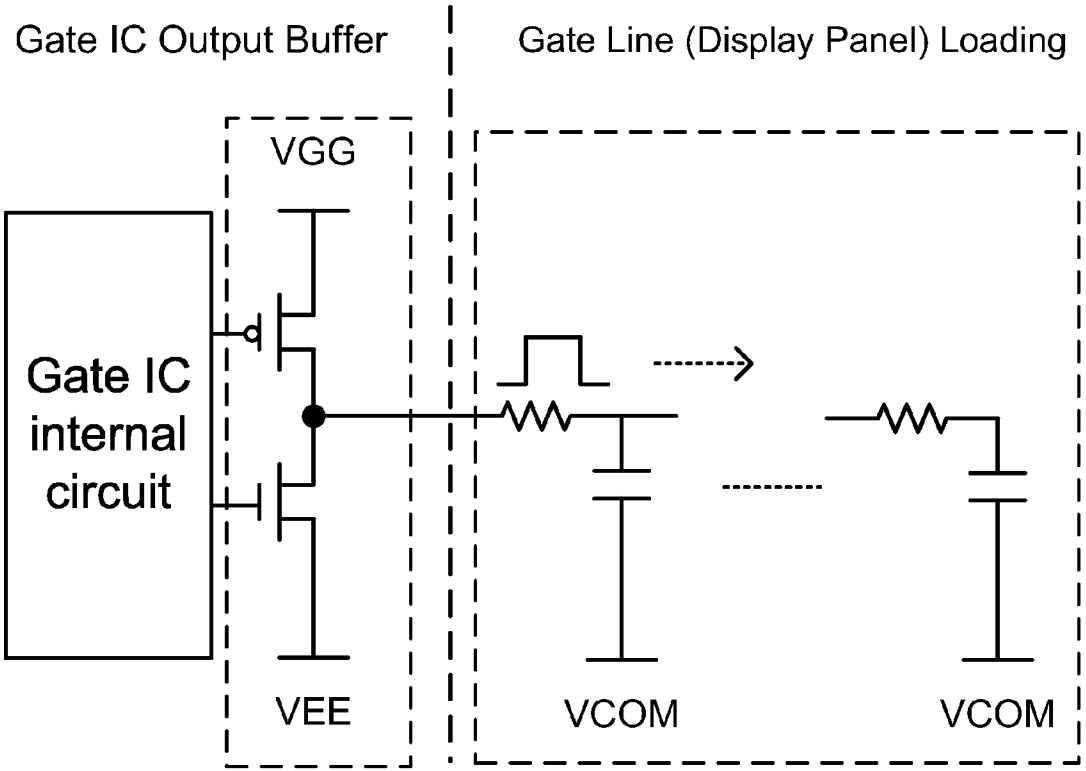
Fig. 2 (Related Art)
FIG. 2 shows a block diagram of a conventional gate driver circuit.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. The use of examples anywhere in this specification, including examples of any terms discussed herein, is illustrative only, and in no way limits the scope and meaning of the invention or of any exemplified term. Likewise, the invention is not limited to various embodiments given in this specification.

As used herein, the terms "comprise or comprising", "include or including", "have or having", "contain or containing" and the like are to be understood to be open-ended, i.e., to mean including but not limited to.

The description will be made as to the embodiments of the present invention in conjunction with the accompanying drawings in FIGS. 1-8. In accordance with the purposes of this invention, as embodied and broadly described herein, this invention, in one aspect, relates to a gate driver circuit usable in the LCD.

Figure 3:
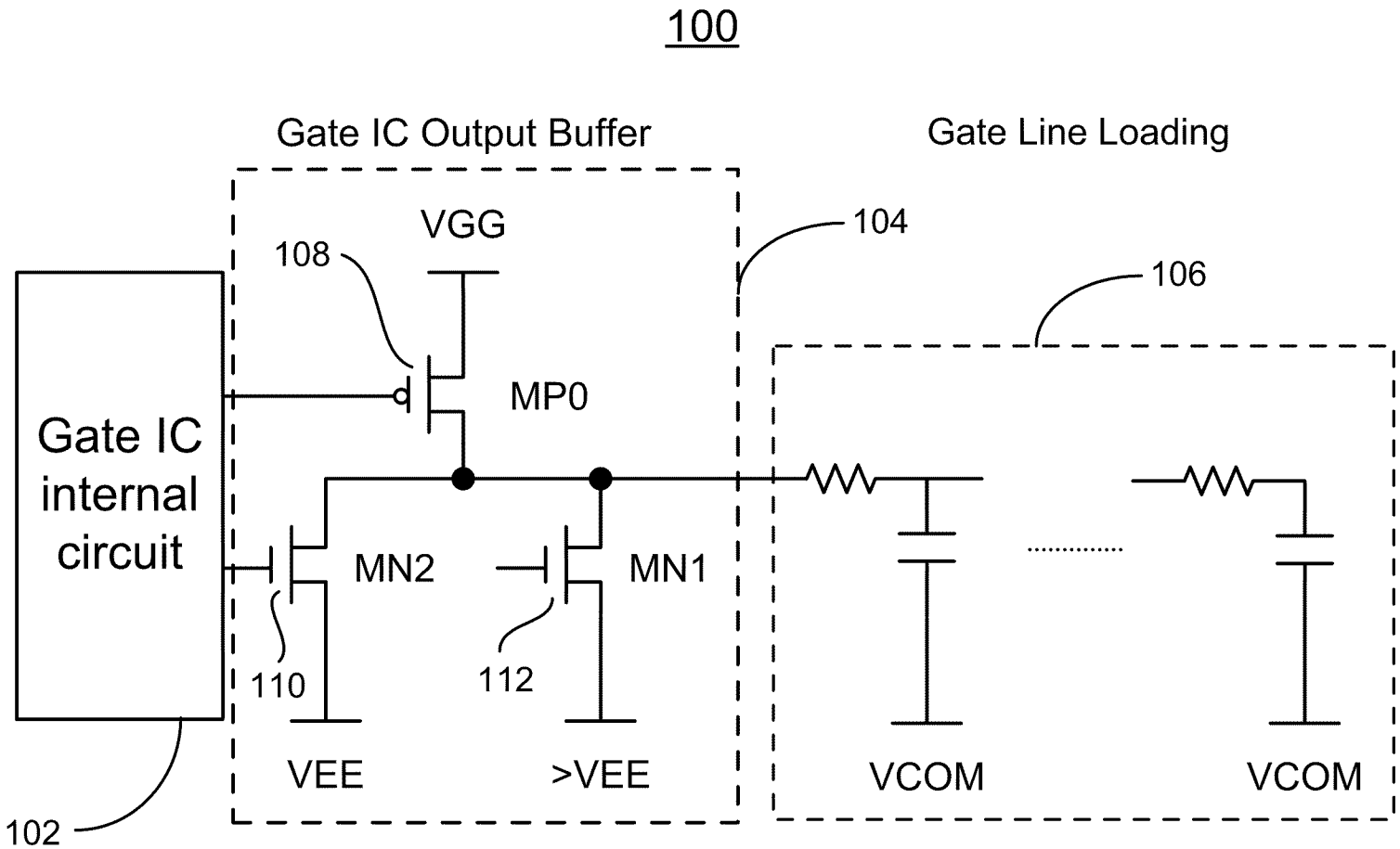
FIG. 3 shows a block diagram of a gate driver circuit according to one embodiment of the present invention.

Referring to FIG. 3, a gate driver circuit 100 in the TFT-LCD according to one embodiment of the present invention includes a gate IC internal circuit 102, gate IC output buffer circuit 104, and gate line loading circuit 106. The gate IC internal circuit 102 generates a set of scanning signals to be driven by the gate IC output buffer 104, which modifies a falling edge of the scanning signal according to a slope or linear function that defines a waveform shape for the modified scanning signal. Specifically, the falling edge of the scanning signal is modified to form a scanning signal with a waveform in the shape of trapezoid.

The gate IC output buffer 104 as shown in FIG. 3 includes a PMOS transistor and two NMOS transistors. Specifically, the PMOS transistor 108 has its source line connected to a high voltage VGG and its gate line coupled to the gate IC internal circuit 102. On the other hand, the first one of the NMOS transistors 110 in the gate IC output buffer 104 has its source line connected to a drain line of the PMOS transistor 108, its gate line coupled to the gate IC internal circuit 102, and its drain line connected to a low voltage VEE. The other one of the NMOS transistors 112 has a drain line connected to VEE, and shares a common source line with the first one of the NMOS transistors 110, noting that the common source line is connected to the drain line of the PMOS transistor 108. The NMOS transistor 112 in the gate IC output buffer 104 allows for a source-level access to additional VEE so that the falling edge of the scanning signal's waveform can be controlled.

Additionally, the gate line loading circuit 106 as shown in FIG. 3 receives a scanning signal of modified waveform from the gate IC output buffer 104, and has a set of resistors and capacitors interconnected in a series of L configurations. Specifically, one end of each of the capacitors is connected to VCOM while the other end of each of the capacitors is coupled to a line of resistors.

Figure 4:
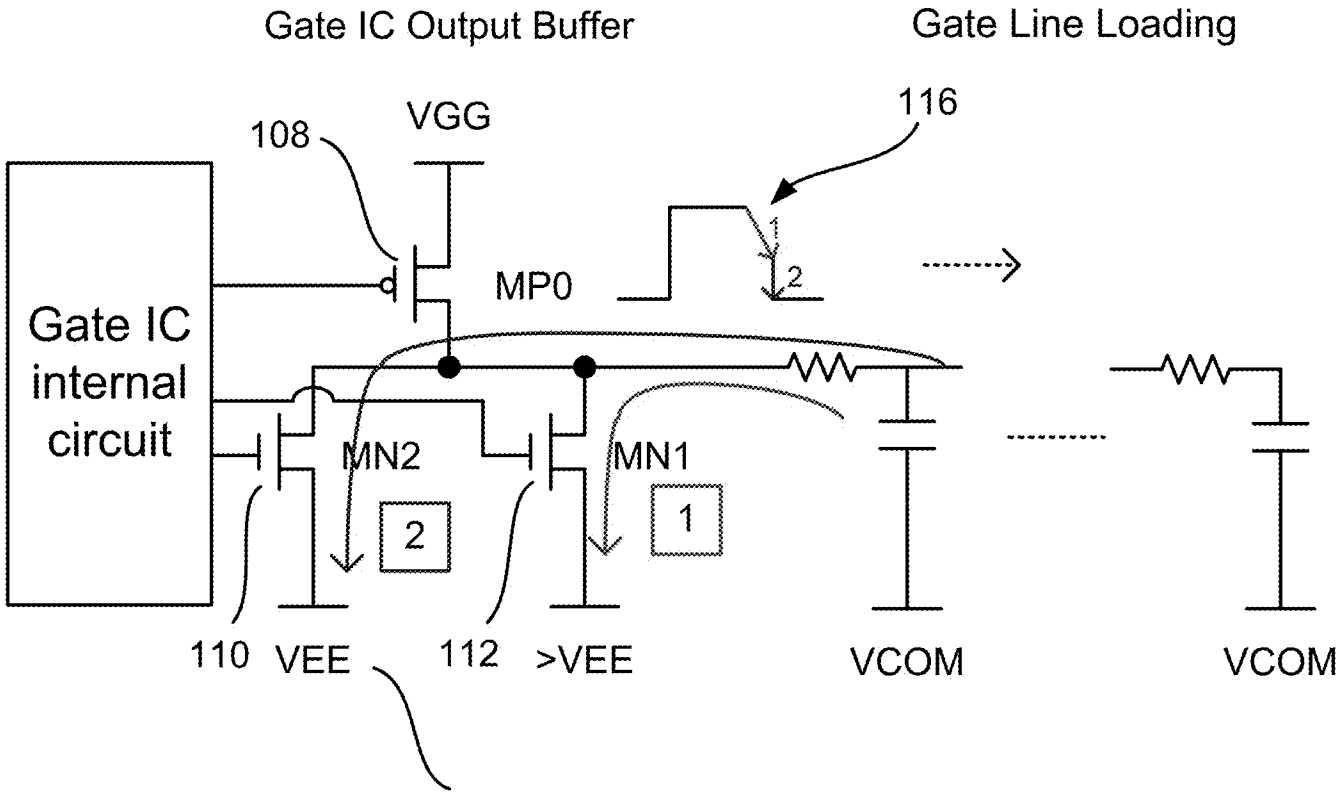
FIG. 4 shows a schematic circuit diagram, partly in block, representing the operation of the gate driver circuit according to the one embodiment of the present invention.

Alternatively, said gate IC output buffer comprises first and second discharging paths for discharging said scanning signal at different times. In one embodiment, said gate IC output buffer circuit is configured such that when said scanning signal falls, the first discharging path is turned on for discharging of said scanning signal at a first current for a period of time, and the second discharging path is sequentially turned on for discharging of said scanning signal at a second current greater than the first current, so as to modify the falling edge of said scanning signal according to a linear function that defines a waveform shape for said modified scanning signal. As shown in FIGS. 3 and 4, said gate IC output buffer circuit comprises a PMOS transistor having a source line coupled to a VGG voltage, a gate line connected to said gate IC internal circuit, and a drain line connected to said gate line loading circuit; a first NMOS transistor having a source line coupled to a VEE voltage, a gate line connected to said gate IC internal circuit, and a drain line connected to said drain line of said PMOS transistor, and a second NMOS transistor having a source line connected to a >VEE voltage, a gate line connected to said gate IC internal circuit, and a drain line connected to said drain line of said PMOS transistor. When the second NMOS transistor is turned on, the first discharging path is turned on, and vice versa, and wherein the first NMOS transistor is turned on, the second discharging path is turned on, and vice versa. In one embodiment, said linear function is determined by a turn-on period of said second NMOS transistor.

As shown in FIG. 4, the falling edge of the trapezoidal waveform 116 is divided into sections 1 and 2. Section 1 is formed by opening the NMOS transistor 112 indicated as MN1, causing the source of MN1 to access >VEE with a relatively smaller current flow. Subsequently, section 2 is formed by opening NMOS transistor 110 indicated as MN2, causing the source of MN2 to access VEE, with a relatively greater current flow. As a result, the shape of the output waveform for the scanning signal from the gate IC output buffer can be controlled.

Figure 5:
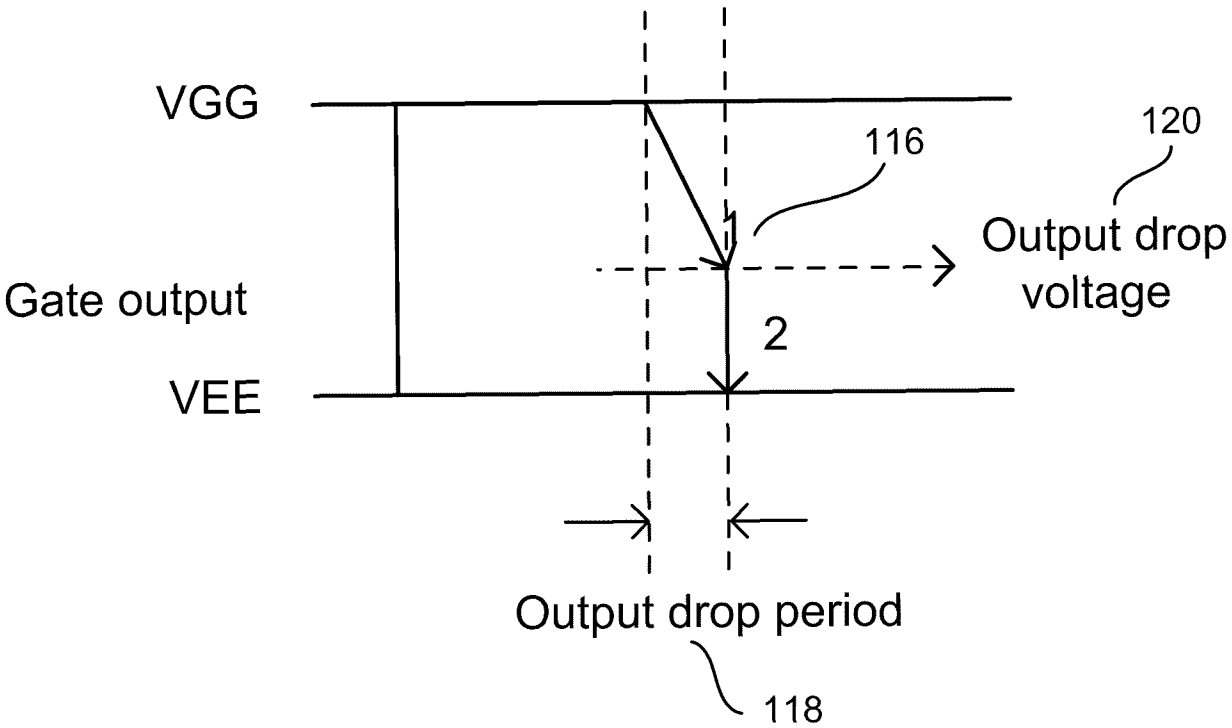
FIG. 5 shows a waveform diagram of a scanning signal having the falling edge changed according to the one embodiment of the present invention.

Referring to FIG. 5, the period of which MN1 is opened controls the width of the output drop period, and in turn controls the output drop voltage. Such linear control to produce the trapezoidal waveform 116 is demonstrated by the gradual slope of section 1 to the output drop voltage, then the vertical slope of section 2 to the end of the output drop period.

Figure 6:
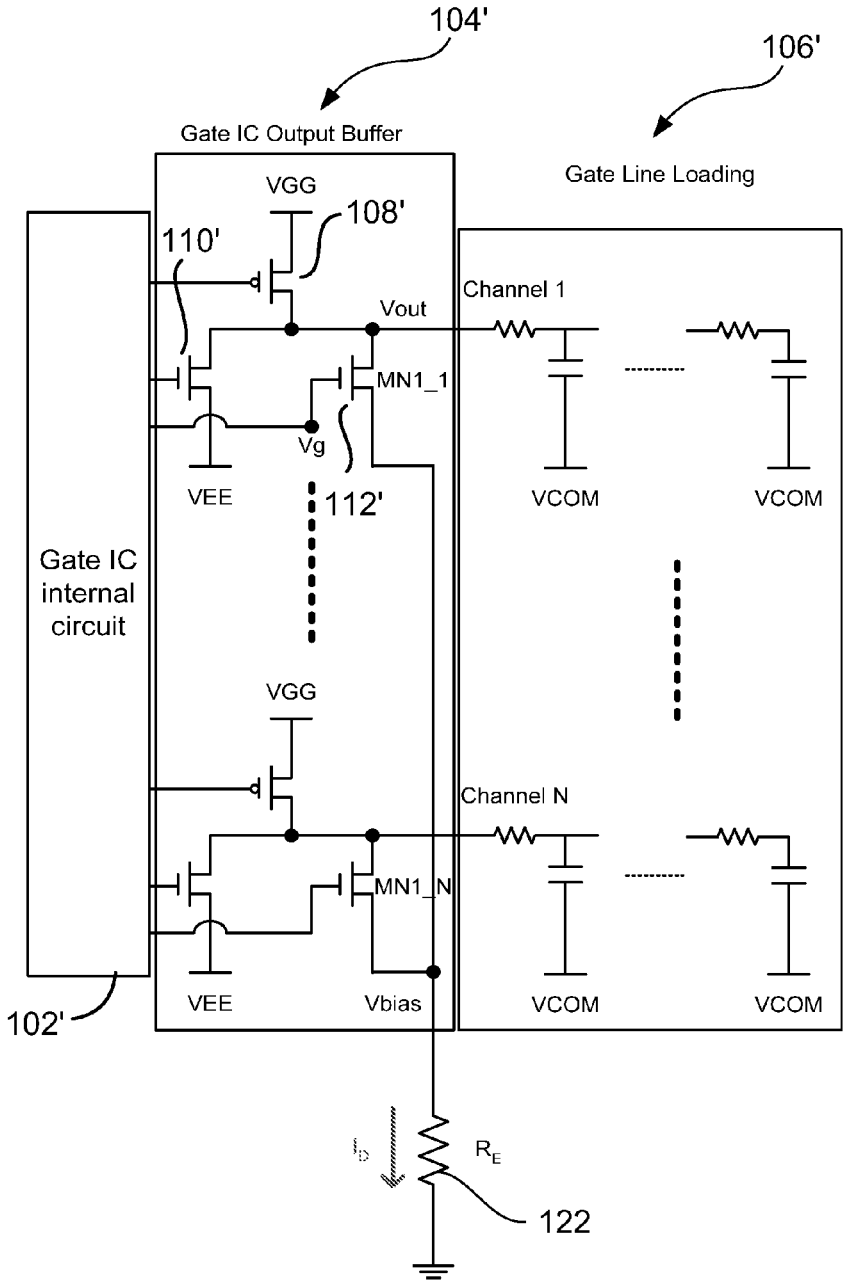
FIG. 6 shows a schematic circuit diagram, partly in block, representing a first configuration of the gate driver circuit according to the one embodiment of the present invention.

In a first configuration according to another aspect of the present invention as shown in FIG. 6, the LCD has a gate IC internal circuit 102' for generating a scanning signal, a gate IC output buffer circuit 104' for modifying the scanning signal according to a linear function, a gate line loading circuit 106' for receiving the modified scanning signal from the gate IC output buffer circuit 104'. The gate IC output buffer circuit 104' has at least two sets of circuitries each comprising a PMOS transistor 108', a first NMOS transistor 110', and a second NMOS transistor 112'.

Specifically, a resistor $R_E$ 122 has one end connected to a source line of each one of the second NMOS transistors 112', and the other end connected to ground.

Since the resistor $R_E$ 122 is coupled to each source channel of each one of the second NMOS transistors 112', the output voltage Vout would proportionally decrease due to the bias voltage Vbias, thereby controlling the output drop voltage 120. Additionally, the turn on time period of each of the second NMOS transistors 112' would determine the output drop period 118.

Within each set of circuitry, the PMOS transistor 108' has a source line coupled to a VGG voltage, a gate line connected the gate IC internal circuit 102', and a drain line connected to a Vout voltage to the gate line loading circuit 106'; the first NMOS transistor 110' has a source line coupled to a VEE voltage, a gate line connected to the gate IC internal circuit 102', and a drain line connected to the drain line of the PMOS transistor 108'; and the second NMOS transistor 112' has a source line connected to a Vbias voltage, a gate line connected to the gate IC internal circuit, and a drain line connected to the Vout voltage and drain line of the PMOS transistor 108'.

The following equations dictate the Vout and Vbias voltages:

$$Vout \cong Vbias,$$

$$Vbias = I_D \times R_E = K'\frac{W}{2L}(Vg - Vbias - V_T)^2 \times R_E$$

when $0<(Vg-Vbias-V_T)\leqq(Vout-Vbias)$, or $$Vbias = K'\frac{W}{L}\left[(Vg - Vbias - V_T) - \frac{(Vout - Vbias)}{2}\right](Vout - Vbias) \times R_E$$

when $0<(Vout-Vbias)\leqq(Vg-Vbias-V_T)$, where the current across the resistor 122 is designated as $I_D$.

Figure 7:
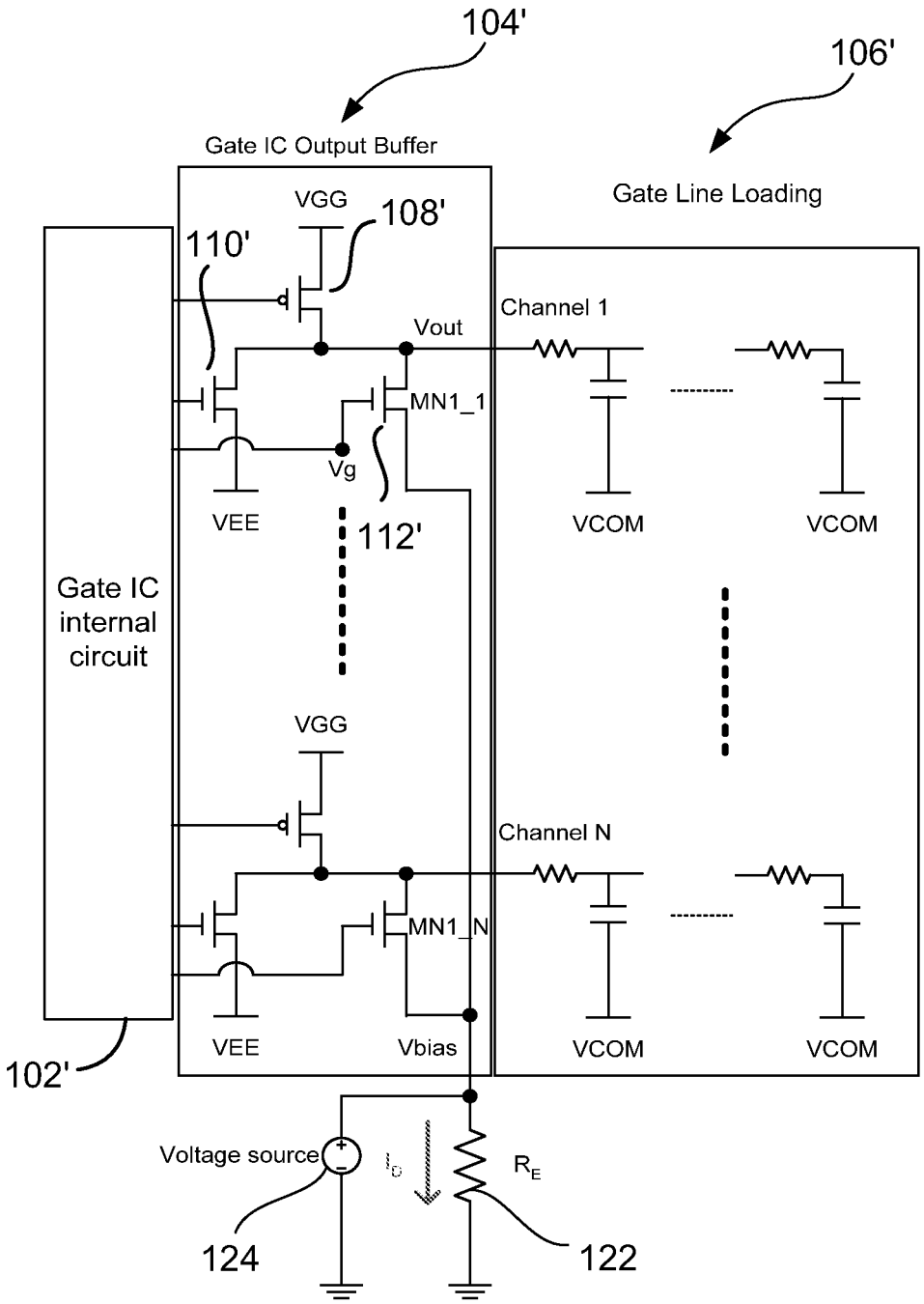
FIG. 7 shows a schematic circuit diagram, partly in block, representing a second configuration of the gate driver circuit according to the one embodiment of the present invention.

In a second configuration as shown in FIG. 7, the LCD has a gate IC internal circuit 102' for generating a scanning signal, a gate IC output buffer circuit 104' for modifying the scanning signal according to a linear function, a gate line loading circuit 106' for receiving the modified scanning signal from the gate IC output buffer circuit 104'. The gate IC output buffer circuit 104' has at least two sets of circuitries each comprising a PMOS transistor 108', a first NMOS transistor 110', and a second NMOS transistor 112'.

Specifically, a resistor $R_E$ 122 has one end connected to each source line of each one of the second NMOS transistors 112', and the other end connected to ground. Also, a voltage source 124 is connected to the resistor 122 on one end, and to the ground at the other end.

Since the voltage source 124 and the resistor 122 are coupled to a gate IC output buffer 104' on one end so that each source line of each one of the second NMOS transistors 112' is subjected to a fixed current due to the resistance, the output voltage Vout would proportionally decrease due to the bias voltage Vbias, thereby controlling the output drop voltage 120. Additionally, the turn on time period of each of the second NMOS transistors 112' would determine the output drop period 118.

The following equations dictate the Vout and Vbias voltages:

$$Vout = Vbias + I_D \times Ron,$$

$$I_D = Vbias/R_E, \text{ and}$$

$$Ron = MN1 \text{ (turn on resistance)},$$

where $I_D$ is the current across the resistor $R_E$, and Ron is the turn on resistance of the second NMOS transistor.

Figure 8:
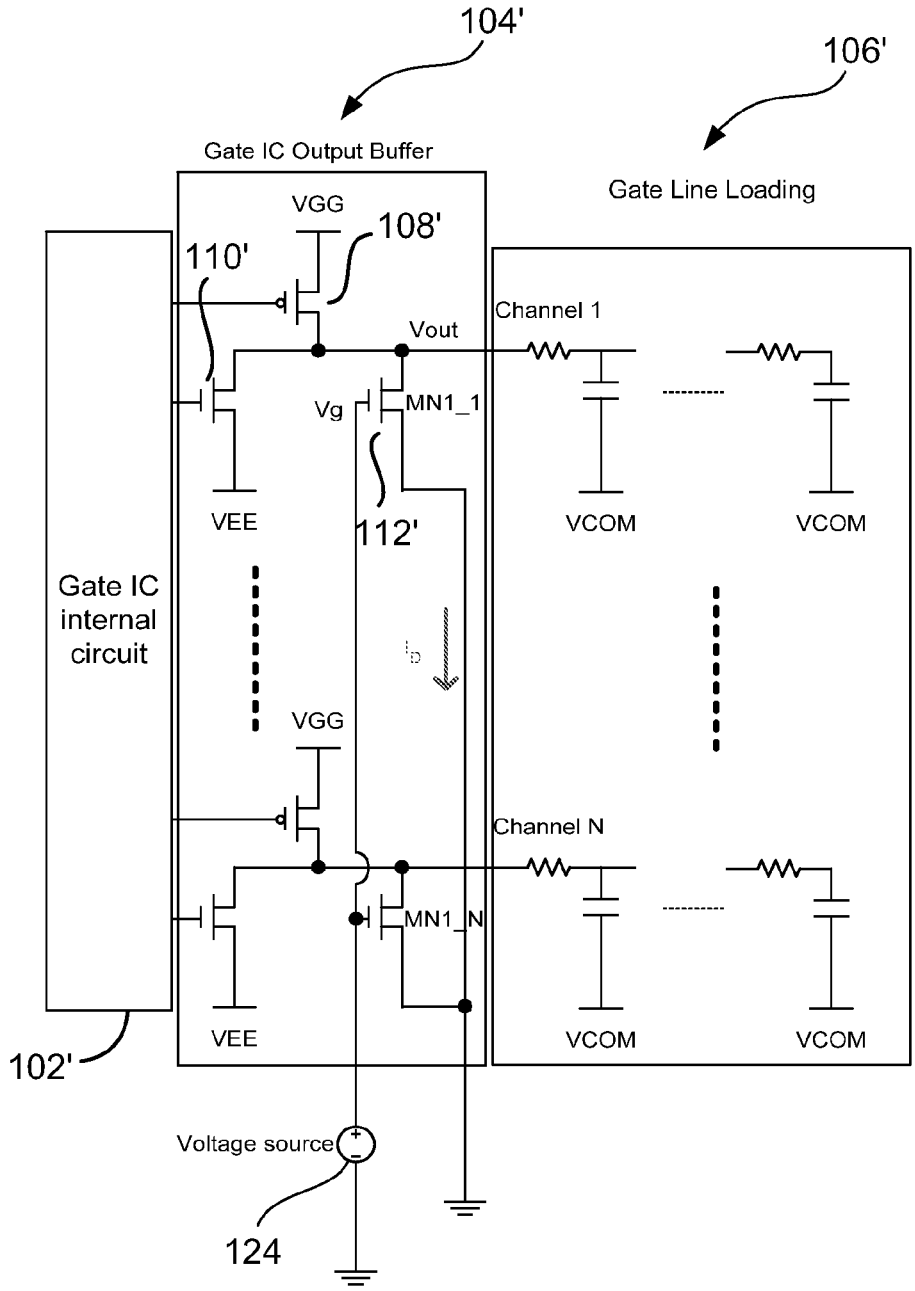
FIG. 8 shows a schematic circuit diagram, partly in block, representing a third configuration of the gate driver circuit according to the one embodiment of the present invention.

In a third configuration as shown in FIG. 8, the LCD has a gate IC internal circuit 102' for generating a scanning signal, a gate IC output buffer circuit 104' for modifying the scanning signal according to a linear function, a gate line loading circuit 106' for receiving the modified scanning signal from the gate IC output buffer circuit 104'. The gate IC output buffer circuit 104' has at least two sets of circuitries each comprising a PMOS transistor 108', a first NMOS transistor 110', and a second NMOS transistor 112'.

Specifically, a voltage source 124 is connected to a gate line of one of the NMOS transistors 112' at one end, and connected to the ground at the other end, whereby a source line of one of the NMOS transistors 112' is connected to ground.

Since the voltage source 124 is connected to each gate channel of each one of the NMOS transistors 112', and each source channel of each one of the NMOS transistors 112' is grounded. The output voltage Vout would be subjected to VGG when each of the NMOS transistor 112' is turned on, thereby controlling the output drop voltage 120. Additionally, the turn on time period of each NMOS transistor 112' would determine the output drop period 118.

The following equations dictate the Vout and Vbias voltages, noting that $I_D$ is the current from the source line of the second NMOS transistor and Ron is the turn on resistance of the second NMOS transistor:

$$Vout = I_D \times R_{on},$$

$$I_D = K'\frac{W}{2L}(Vg - V_T)^2,$$

and $$Ron = MN1 \text{ (turn on resistance)}.$$

According to yet another aspect of the present invention, a method for modifying a scanning signal in a liquid crystal display (LCD) is accomplished by taken the steps of generating the scanning signal through a gate IC internal circuit, modifying the scanning signal through a gate IC output buffer circuit according to a linear function based on an output drop period and an output drop voltage; and receiving a modified scanning signal through a gate line loading circuit.

Specifically, the modified scanning signal has a falling edge with a linear function that defines a waveform shape for the modified scanning signal. Also, by controlling the output drop voltage and output drop period, the waveform of the scanning signal can take a trapezoidal shape.

In one configuration, the method includes connecting one end of a resistor to a source line of one of the transistors, and the other end to ground. In another configuration, the method includes connecting a voltage source to the resistor at one end, and to the ground at the other end. In yet another configuration, the method includes connecting a voltage source to a gate line of one of the transistors at one end, and to the ground at the other end, of which a source line of one of the NMOS transistors is connected to ground.

As described above, the gate driver circuit incorporates two distinct transistors to achieve linear control of the output signal. Through logic operation and time control, the output signal of the gate driver circuit can be modified.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A gate driver circuit usable in a liquid crystal display (LCD), comprising:

(a) a gate IC internal circuit for generating scanning signals;

(b) a gate IC output buffer circuit for modifying said scanning signals according to a linear function; and (c) a gate line loading circuit having N channels for respectively receiving said modified scanning signals from said gate IC output buffer circuit, N being an integer greater than 1, wherein said gate IC output buffer circuit has N sets of circuit components, each circuit component set having an output node connected to a corresponding channel of said gate line loading circuit for outputting a corresponding one of said modified scanning signals to said corresponding channel of said gate line loading circuit, and comprising:

(i) a PMOS transistor having a source end coupled to a VGG voltage, a gate end receiving signal from said gate IC internal circuit, and a drain end connected to said corresponding channel of said gate line loading circuit, (ii) a first NMOS transistor having a source end coupled to a VEE voltage, a gate end receiving signal from said gate IC internal circuit, and a drain end connected to said drain end of said PMOS transistor, and (iii) a second NMOS transistor having a source end, a gate end, and a drain end connected to said drain end of said PMOS transistor, wherein said source end of said second NMOS transistor of each of said N sets of circuit components is connected to a common node that is not directly connected to any one of said output nodes of said N sets of circuit components, and wherein said common node has a Vbias voltage.

2. The gate driver circuit of claim 1, wherein each circuit component set of said gate IC output buffer circuit modifies a falling edge of said corresponding scanning signal according to said linear function that defines a waveform shape for said corresponding modified scanning signal.

3. The gate driver circuit of claim 2, wherein said waveform shape is a trapezoid.

4. The gate driver circuit of claim 2, wherein each circuit component set of said gate IC output buffer circuit comprises first and second paths for discharge at different times and is configured such that when said scanning signal falls, the first discharging path is turned on for discharging of said scanning signal at a first current for a period of time, and the second discharging path is sequentially turned on for discharging of said scanning signal at a second current greater than the first current, so as to modify the falling edge of said scanning signal according to the linear function that defines a waveform shape for said modified scanning signal.

5. The gate driver circuit of claim 4, wherein when the second NMOS transistor is turned on, the first discharging path is turned on, and vice versa, and wherein the first NMOS transistor is turned on, the second discharging path is turned on, and vice versa.

6. The gate driver circuit of claim 1, wherein each channel of said gate line loading circuit comprises at least one resistor connected to a capacitor, wherein one end of said resistor is connected to said output node of a corresponding circuit component set of said gate IC output buffer circuit, and one end of said capacitor is connected to a VCOM voltage.

7. The gate driver circuit of claim 1, wherein said linear function is determined by both output drop period and output drop voltage.

8. The gate driver circuit of claim 7, wherein said output drop period is determined by a turn-on period of said second NMOS transistor.

9. The gate driver circuit of claim 1, wherein said gate end of said PMOS transistor, said gate end of said first NMOS transistor, and said gate end of said second NMOS transistor of each circuit component set of said gate IC output buffer circuit are respectively directly connected to said gate IC internal circuit.

10. A liquid crystal display (LCD), comprising:

(a) a gate IC internal circuit for generating scanning signals;

(b) a gate IC output buffer circuit for modifying said scanning signals according to a linear function; and (c) a gate line loading circuit having N channels for respectively receiving said modified scanning signals from said gate IC output buffer circuit, N being an integer greater than 1, wherein said gate IC output buffer circuit has N sets of circuit components, each circuit component set having an output node directly connected to a corresponding channel of said gate line loading circuit for outputting a corresponding one of said modified scanning signals to said corresponding channel of said gate line loading circuit, and comprising a PMOS transistor, a first NMOS transistor, and a second NMOS transistor, wherein (i) said PMOS transistor has a source end coupled to a VGG voltage, a gate end receiving signal from said gate IC internal circuit, and a drain end directly connected to drain ends of said first and second NMOS transistors for supplying a Vout voltage to said corresponding channel of said gate line loading circuit;

(ii) said first NMOS transistor has a source end coupled to a VEE voltage, a gate end receiving signal from said gate IC internal circuit, and said drain end directly connected to said drain end of said PMOS transistor; and (iii) said second NMOS transistor has a source end, a gate end, and said drain end directly connected to said drain end of said PMOS transistor, wherein said source end of said second NMOS transistor of each of said N sets of circuit components is directly connected to a common node that is not directly connected to any one of said output nodes of said N sets of circuit components, and wherein said common node has a Vbias voltage.

11. The LCD of claim 10, further comprising a voltage source having one end directly connected to the gate end of said second NMOS transistor of each of said N sets of circuit components, and the other end connected to ground, wherein said common node is connected to ground.

12. The LCD of claim 11, wherein said Vout voltage is determined by the following equation:

$$Vout=I_D \times Ron,$$

wherein $I_D$ is the current from the source end of said second NMOS transistor and Ron is the turn on resistance of said second NMOS transistor.

13. The LCD of claim 10, wherein each circuit component set of said gate IC output buffer circuit modifies a falling edge of said corresponding scanning signal according to a slope function that defines a waveform shape for said corresponding modified scanning signal.

14. The LCD of claim 13, wherein said waveform shape is a trapezoid.

15. The LCD of claim 10, wherein each channel of said gate line loading circuit comprises a resistor connected to a capacitor, wherein one end of said resistor is connected to said output node of a corresponding circuit component set of said gate IC output buffer circuit and the other end of said capacitor is connected to a VCOM voltage.

16. The LCD of claim 10, wherein said linear function is determined by both output drop period and output drop voltage, and said output drop period is determined by a turn-on period of said second NMOS transistor.

17. The LCD of claim 10, wherein each circuit component set of said gate IC output buffer circuit comprises first and second paths for discharge at different times and is configured such that when said scanning signal falls, the first discharging path is turned on for discharging of said scanning signal at a first current for a period of time, and the second discharging path is sequentially turned on for discharging of said scanning signal at a second current greater than the first current, so as to modify the falling edge of said scanning signal according to the linear function that defines a waveform shape for said modified scanning signal.

18. The LCD of claim 17, wherein when said second NMOS transistor is turned on, said first discharging path is turned on, and vice versa, and wherein said first NMOS transistor is turned on, said second discharging path is turned on, and vice versa.

19. The LCD of claim 18, wherein said linear function is determined by a turn-on period of said second NMOS transistor.

20. The LCD of claim 10, wherein said gate end of said PMOS transistor, said gate end of said first NMOS transistor, and said gate end of said second NMOS transistor of each circuit component set of said gate IC output buffer circuit are respectively directly connected to said gate IC internal circuit.

21. The LCD of claim 10, further comprising a resistor $R_E$ having one end connected to said common node, and the other end connected to ground.

22. The LCD of claim 21, wherein said Vout voltage is equivalent to said Vbias voltage, and said Vbias voltage is determined by the following equation:

$$Vbias=I_D \times R_E,$$

wherein $I_D$ is the current across said resistor $R_E$.

23. The LCD of claim 21, further comprising a voltage source having one end connected to said common node and said resistor, and the other end connected to ground.

24. The LCD of claim 23, wherein said Vout voltage is determined by the following equation:

$$Vout=Vbias+I_D \times Ron,$$

wherein $I_D$ is the current across said resistor $R_E$, and Ron is the turn on resistance of said second NMOS transistor.

25. A method for modifying scanning signals in a liquid crystal display (LCD), comprising the steps of:

(a) generating said scanning signals through a gate IC internal circuit;

(b) modifying said scanning signals through a gate IC output buffer circuit according to a linear function based on an output drop period and an output drop voltage; and (c) receiving the modified scanning signals through a gate line loading circuit having N channels, N being an integer greater than 1, wherein each modified scanning signal has a falling edge with a slope function that defines a waveform shape for said modified scanning signal;

wherein said gate IC output buffer circuit has N sets of circuit components, wherein each circuit component set has an output node connected to a corresponding channel of said gate line loading circuit for outputting a corresponding one of said modified scanning signals to said corresponding channel of said gate line loading circuit, and comprises:

(i) a PMOS transistor having a source end coupled to a VGG voltage, a gate end receiving signal from said gate IC internal circuit, and a drain end connected to said corresponding channel of said gate line loading circuit, (ii) a first NMOS transistor having a source end coupled to a VEE voltage, a gate end receiving signal from said gate IC internal circuit, and a drain end connected to said drain end of said PMOS transistor, and (iii) a second NMOS transistor having a source end, a gate end, and a drain end connected to said drain end of said PMOS transistor, wherein said source end of said second NMOS transistor of each of said N sets of circuit components is connected to a common node that is not directly connected to any one of said output nodes of said N sets of circuit components, and wherein said common node has a Vbias voltage.

26. The method of claim 25, wherein said gate end of said PMOS transistor, said gate end of said first NMOS transistor, and said gate end of said second NMOS transistor of each circuit component set of said gate IC output buffer circuit are respectively directly connected to said gate IC internal circuit.

* * * * *